US006886363B2

(12) United States Patent
Hara

(10) Patent No.: US 6,886,363 B2
(45) Date of Patent: May 3, 2005

(54) RING

(75) Inventor: Masatsugu Hara, Shizuoka (JP)

(73) Assignee: Jewel Karati Inc., Shizuoka (JP)

( * ) Notice: Subject to any disclaimer, the term of this patent is extended or adjusted under 35 U.S.C. 154(b) by 69 days.

(21) Appl. No.: 10/405,697

(22) Filed: Apr. 3, 2003

(65) Prior Publication Data

US 2003/0188549 A1 Oct. 9, 2003

(30) Foreign Application Priority Data

Apr. 8, 2002 (JP) ..... P2002-104620
Nov. 29, 2002 (JP) ..... P2002-347945

(51) Int. Cl.[7] ..... A44C 9/00; A44C 9/02; A44C 17/02

(52) U.S. Cl. ..... 63/15.4; 63/15.1; 63/26; 63/15.5; D11/26

(58) Field of Search ..... 63/15, 15.1, 15.4, 63/15.5; D11/26, 28, 29, 34

(56) References Cited

U.S. PATENT DOCUMENTS 1,950,526 A * 3/1934 Stetter ..... 63/15.5
2,048,878 A * 7/1936 Moldenhauer ..... 63/15
2,182,876 A * 12/1939 Moldenhauer ..... 63/15
5,428,974 A * 7/1995 Shinohara ..... 63/15

FOREIGN PATENT DOCUMENTS

JP 3049029 5/1998
JP 2001-10016 3/2001
JP 2001-070016 * 3/2001

* cited by examiner

*Primary Examiner*—J J Swann
*Assistant Examiner*—Katherine Mitchell
(74) *Attorney, Agent, or Firm*—Lowe Hauptman Gilman & Berner, LLP

(57) ABSTRACT

A ring allowing a longer length of an arm attached to a ring main body is provided. The tilted ring is tiltingly attached to the ring main body. The tilted ring is in an ellipse shape, and the major axis of the ellipse projected on the plane where the ring main body exists is longer than the diameter of the ring main body. Thus, if the ring main body is worn on the finger on which a wedding ring or the like is already worn, the tilted ring does not interfere with the wedding ring. Thus, since the tilted ring can extend downward in addition to upward of the ring main body, the tilted ring can be longer, and the esthetic appearance increases.

10 Claims, 9 Drawing Sheets

(a)

(b)

(a)

(b)

RING

BACKGROUND OF INVENTION

1. Field of Invention

The present invention relates to a ring.

2. Description of the Related Art

Conventional three-dimensional ring are described in an unexamined patent application publication 2001-70016 and a registered utility model publication 3049029 to the inventor of the present invention. The rings disclosed in both of these documents are such rings that an arm tilted with respect to a ring main body is attached to the top surface of the ring main body.

SUMMARY OF INVENTION

However, since the arm must be placed above the ring main body in the aforementioned three-dimensional rings, the length of the arm is limited. Generally, since the longer the length of the arm becomes, the longer a finger on which the ring is worn looks, the longer arm is esthetically preferable. Thus, the three-dimensional rings described above do not sufficiently contribute to promoting the beauty of the finger wearing the ring.

The purpose of the present invention is to provide a ring which allows extending the length of the arm attached to the ring main body.

According to the present invention, a ring including a ring main body; and a tilted ring tiltingly attached to the ring main body, wherein the minimum inside radius of the tilted ring is equal to or larger than the outside radius of the ring main body, and the maximum inside radius of the tilted ring projected on a plane where the ring main body exists is equal to or larger than the outside radius of the ring main body.

It is assumed that the arms described in the Prior Art are simply attached above and below the ring main body. In this case, if another ring (such as a wedding ring) is already worn on the finger, the arm attached below the ring main body interferes with the other ring. Thus, the arm described in the Prior Art cannot be attached both above and below the ring main body.

However, with the ring constituted as described above, the tilted ring projected on the plane where the ring main body exists encloses the ring main body. Thus, even if a ring having a diameter similar to that of the ring main body is already worn, the tilted ring does not interfere with the other ring. Therefore, with the ring constituted as described above, since the tilted ring can extend above and below the ring main body, the length of the tilted ring can be made long.

A further aspect of the present invention has the tilted ring placed above or below the ring main body.

A further aspect of the present invention has the tilted ring is an ellipse.

A further aspect of the present invention has parts where the tilted ring has the minimum inside radius are in contact with the outer peripheral surface of the ring main body.

A further aspect of the present invention, the ring further includes spacers placed between parts where the tilted ring has the minimum inside radius and the outer periphery of the ring main body.

With the ring constituted as described above, the minimum inside radius of the tilted ring is larger than the outside radius of the ring main body by the amount of the spacer. Thus, even if another ring having the diameter larger than that of the ring main body is already worn, the tilted ring does not interfere with the other ring.

A further aspect of the present invention is the ring according to claim 1, wherein a disconnection is provided on the ring main body or the tilted ring.

With the ring constituted as described above, the inside radius of the ring main body is variable. Thus, it is possible to adapt the inside radius of the ring main body to the thickness of a finger which wears the ring.

A further aspect of the present invention, the ring further includes an arm attached to an end of the ring main body or the tilted ring, and is placed above or below the ring main body.

With the ring constituted as described above, the arm adds a further change to the aesthetic appearance.

A further aspect of the present invention has a decoration member attached to the ring main body or the tilted ring.

A further aspect of the present invention further includes a decoration member attached to the arm.

With the ring constituted as described above, the decoration member adds a further change in the aesthetic appearance.

DESCRIPTION OF THE PREFERRED EMBODIMENT

The following section describes embodiments of the present invention while referring to drawings.

First Embodiment

Figure 1:
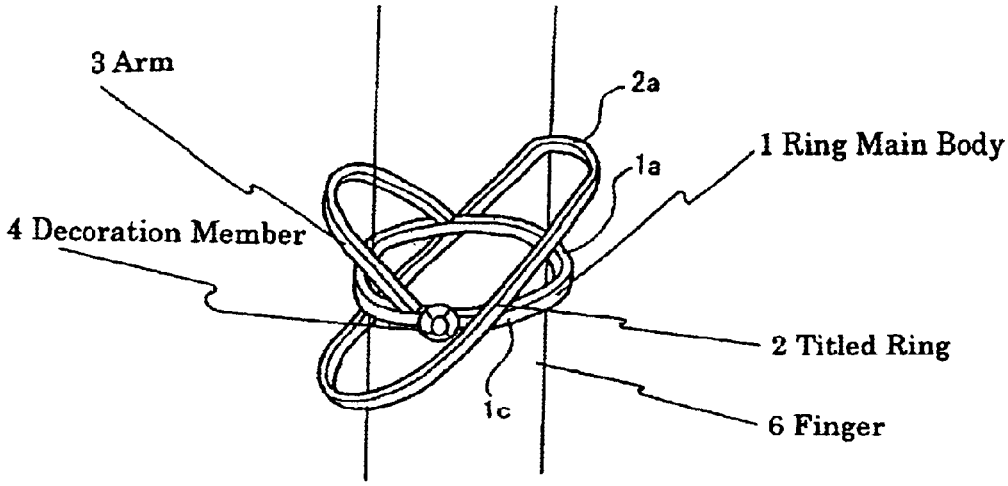
FIG. 1 is a perspective view of a ring according to a first embodiment of the present invention.

FIG. 1 is a perspective view of a ring according to a first embodiment of the present invention. The ring comprises a ring main body 1, a tilted ring 2, an arm 3, and a decoration member 4. The ring is worn on a finger 6. The arm 3 and the decoration member 4 may be omitted.

The ring main body 1 is a circular ring. The material of the ring main body 1 is noble metal, or gold-plated or silver-plated base metal other than noble metal. The base metal other than noble metal used for the ring main body 1 is copper or nickel, for example. Note that the base metal may be other metal suitable for gold plating or silver plating. The ring main body 1 may have a wave shape undulating in the up/down direction as long as it is circular. The section of the ring main body 1 may be a circle, an ellipse, or a polygon.

The tilted ring 2 is tiltingly attached to the ring main body 1. The tilted ring 2 is an ellipse, for example.

The arm 3 is attached on an end surface la of the ring main body 1, and extends upward.

The decoration member 4 is attached to the outer periphery 1*c* of the ring main body 1. The decoration member 4 is precious stone, noble metal, or pearl with added decoration. Though, in FIG. 1, the decoration member 4 is attached to a neighborhood of the place where the arm 3 is attached to the tilted ring 2, the decoration member 4 can be attached to another place.

Figure 2:
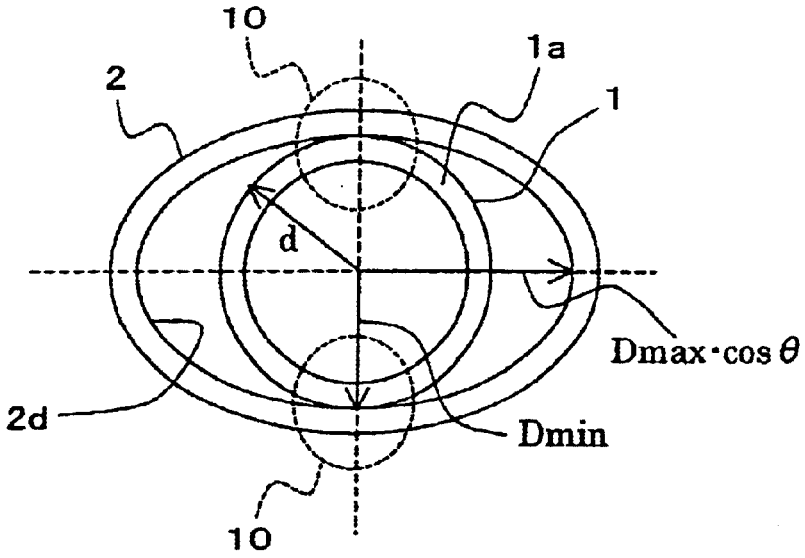
FIGS. 2 include a plan view ((FIG. 2(*a*)) and a front view (FIG. 2(*b*)) of the ring according to the first embodiment of the present invention.
Figure 2:
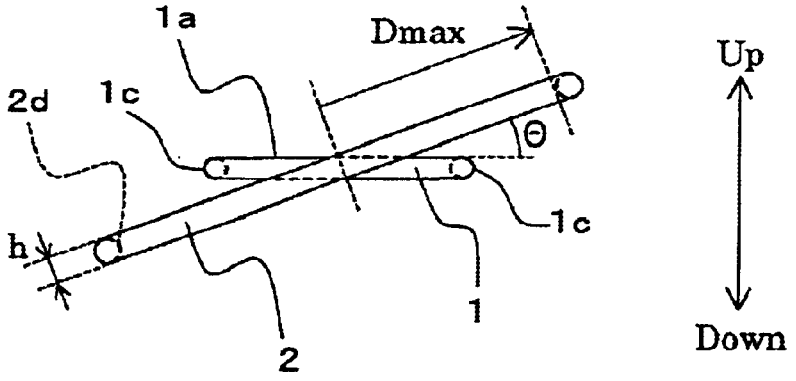

FIGS. 2 includes a plan view ((FIG. 2(*a*)) and a front view (FIG. 2(*b*)) of the ring according to the first embodiment of the present invention. Note that the arm 3 and the decoration member 4 are not shown in the drawing.

The inner periphery 2*d* of the tilted ring 2 is an ellipse having the diameter of the major axis of 2Dmax (see FIG. 2(*b*)) and the diameter of the minor axis of 2Dmin (see (FIG. 2(*a*)). Thus, the tilted ring 2 itself is an ellipse. Note that Dmax is the radius of the major axis, and Dmin is the radius of the minor axis. The tilted ring 2 is tilted by an angle of θ with respect to the ring main body 1 (see FIG. 2(*b*)). The tilted ring 2 extends upward and downward of the ring main body 1 (see FIG. 2(*b*)). Dmax·cos θ is the radius of the major axis projected on the plane on which the ring main body 1 exists. Dmax·cos θ is equal to or larger than the outside diameter (d) of the ring main body 1. It is assumed that Dmin=d. Thus, the parts on the inner periphery 2*d* of the tilted ring 2 corresponding to the minor axis are in contact with the outer periphery 1*c* of the ring main body 1 (see (FIG. 2(*a*)). The tilted ring 2 is fixed to the ring main body 1 with brazing, for example, at the joint parts 10 where the tilted ring 2 and the ring main body 1 are in contact with each other. It is preferable that Dmax·cos θ is large enough for smoothly inserting the finger 6 into the ring without interfering with the tilted ring 2. However, it is also preferable to make the gap between the finger 6 and the tilted ring 2 as small as possible. Further, the thickness (h) of the tilted ring 2 is generally constant.

Figure 3:
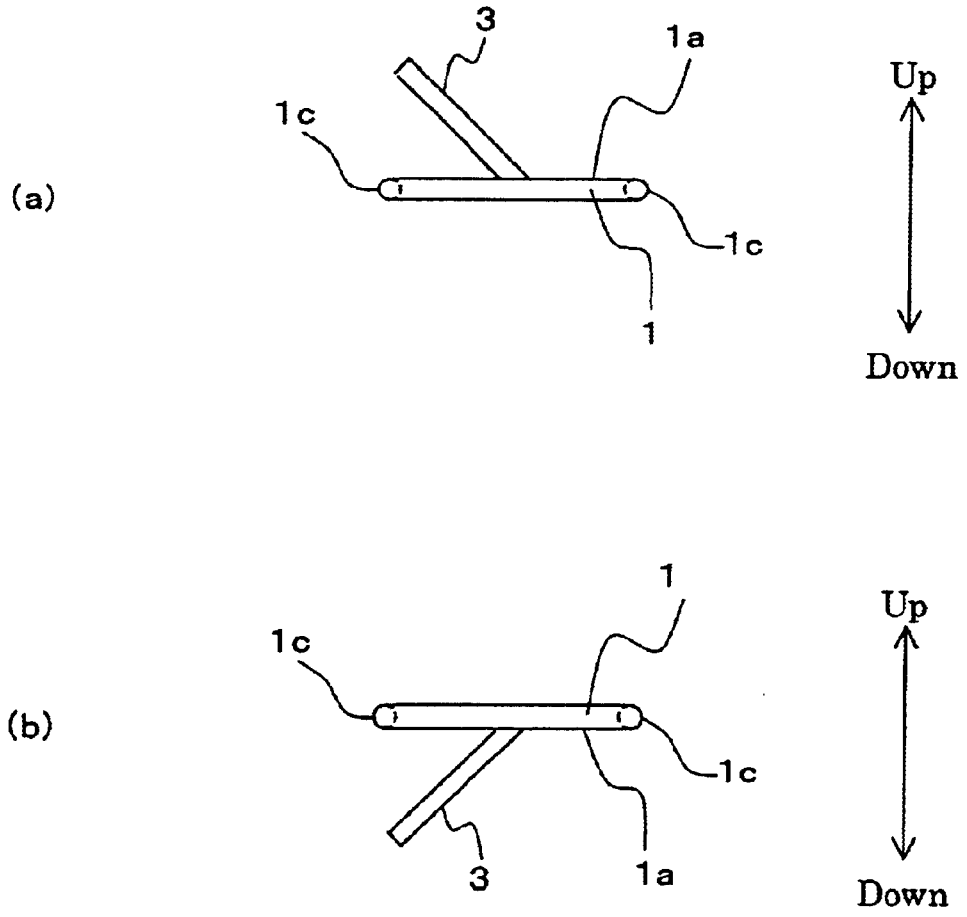
FIG. 3 is a plan view of the ring according to the first embodiment of the present invention.

FIG. 3 is a front view of the ring according to the first embodiment of the present invention. Note that the tilted ring 2 and the decoration member 4 are not shown in the drawing. Referring to FIG. 3(*a*), the arm 3 is attached to the upper end surface 1*a* of the ring main body 1, and extends upward. Referring to FIG. 3(*b*), if the ring is turned upside down, the arm 3 extends downward. Note that the arm 3 extends either upward or downward of the tilted ring 2, but not both upward and downward of it.

Figure 4:
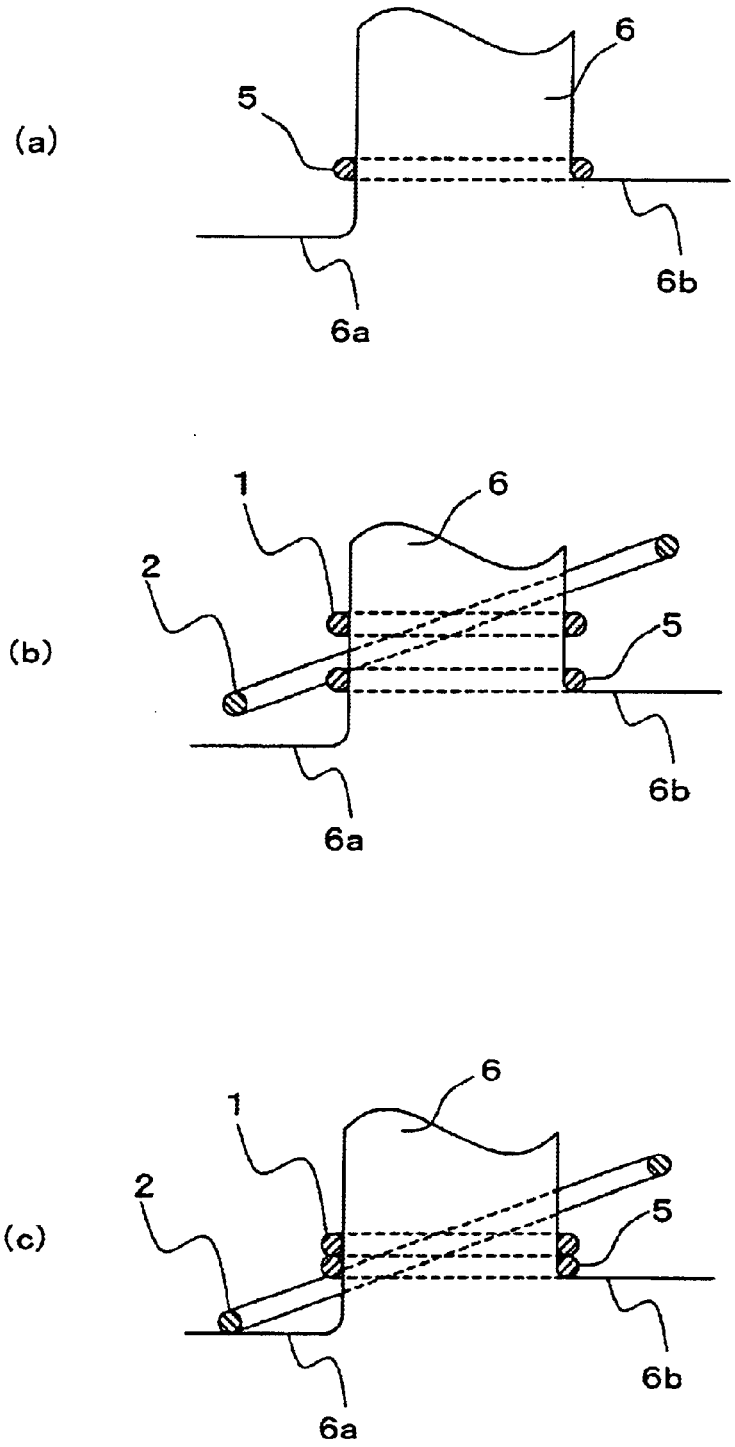
FIGS. 4 are views describing the actions when the ring according to the first embodiment is worn, and include a sectional view when the ring 5 is worn on the finger 6 (FIG. 4(*a*)), a sectional view showing a state in the course of wearing the ring according to the first embodiment on the finger 6 (FIG. 4(*b*)), and a sectional view showing a state where the ring according to the first embodiment is completely worn on the finger 6 (FIG. 4(*c*))

The following section describes actions when the ring according to the first embodiment is worn while referring to FIG. 4.

FIG. 4(*a*) is a sectional view when another ring 5 is worn on the finger 6. The positions of base of the finger 6 largely differ from each other on the left and right sides of the finger 6. Namely, the base 6*a* on the left is lower than the base 6*b* on the right. The other ring 5 is worn on the finger 6 while it is in contact with the right base 6*b*. The finger 6 is the third finger, and the other ring 5 is a wedding ring, for example. The ring according to the first embodiment is preferable to be worn on the finger 6 in this state. The other ring 5 takes a ring shape, and has a diameter approximately similar to that of the ring main body 1.

FIG. 4(*b*) is a sectional view showing an intermediate state in the course of wearing the ring according to the first embodiment on the finger 6. After the ring main body 1 is placed on the finger 6, and the ring main body 1 is brought down toward the bases 6*a* and 6*b* of the finger 6, the left side of the tilted ring 2 becomes lower than the other ring 5. However, the tilted ring 2 does not interfere with the other ring 5. At this moment, the ring according to the first embodiment viewed from directly above presents the state shown in FIG. 2(*a*). The other ring 5 is directly below the ring main body 1, and is not visible. As understood by referring to FIG. 2(*a*), the tilted ring 2 projected on the plane where the ring main body 1 exists encloses the ring main body 1. Thus, the tilted ring 2 does not interfere with the other ring.

When one tries to wear the ring shown in FIG. 3(*b*) on the finger 6, the arm 3 interferes with the other ring 5. Note that the tilted ring 2 does not interfere with the ring 5 since the tilted ring 2 is formed as described above.

FIG. 4(*c*) is a sectional view showing a state where the ring according to the first embodiment is completely worn on the finger 6. An end surface 1*a* of the ring main body 1 and the other ring 5 are in contact with each other. In addition, the left side of the tilted ring 2 is in contact with the left base 6*a*. However, since the right side of the tilted ring 2 is higher by the tilted amount, it is not pressed into the right base 6*b*.

The first embodiment provides the following effects.

It is assumed that the arms 3 are simply attached to the upper side and the lower side of the ring main body 1. In this case, if another ring 5 is already worn on the finger 6, the arm 3 attached to the lower side of the ring main body 2 interferes with the other ring 5. Thus, it is not possible to attach the arms 3 to the upper side and the lower side of the ring main body 1.

However, with the first embodiment, the tilted ring 2 projected on the plane where the ring main body 1 exits encloses the ring main body 1. Thus, even if the other ring 5 having the diameter similar to that of the ring main body 1 is already worn, the tilted ring 2 does not interfere with the other ring 5. Therefore, since the tilted ring 2 may extend upward and downward of the ring main body 1, it is possible to make the length of the tilted ring 2 longer. This constitution is advantageous for aesthetic appearance.

Further, various variations are possible for the first embodiment.

Figure 5:
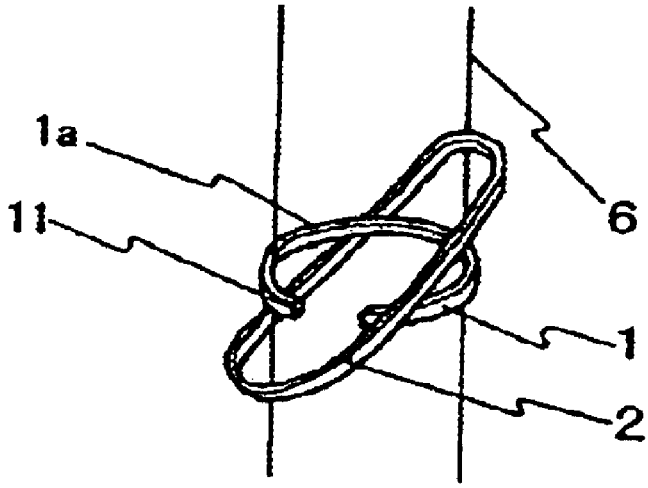
FIG. 5 is a perspective view of a variation where the shape of the ring main body 1 is changed.

For example, the shape of the ring main body 1 may be changed. FIG. 5 is a perspective view showing a variation where the shape of the ring main body is changed. A disconnection 11 is provided on the ring main body 1. With this constitution, the inside diameter of the ring main body 1 is variable. Thus, it is possible to adapt the inside diameter of the ring main body to the thickness of the finger 6 which wears the ring.

Also, the shape of the tilted ring 2 may be changed. The first embodiment is described while it is assumed that the shape of the tilted ring 2 is an ellipse. However, the shape of the tilted ring 2 is not necessarily an ellipse in a mathematical sense as long as the shape satisfies that (1) the minimum inside radius is equal to or larger than the outside radius (d) of the ring main body 1, and (2) the maximum inside radius projected on the plane where the ring main body 1 exits is equal to or larger than the outside radius (d) of the ring main body 1. For example, the shape of the tilted ring 2 may be an oblong circle partially including straight parts. Further, changes in shape shown in FIG. 6 are possible.

Figure 6:
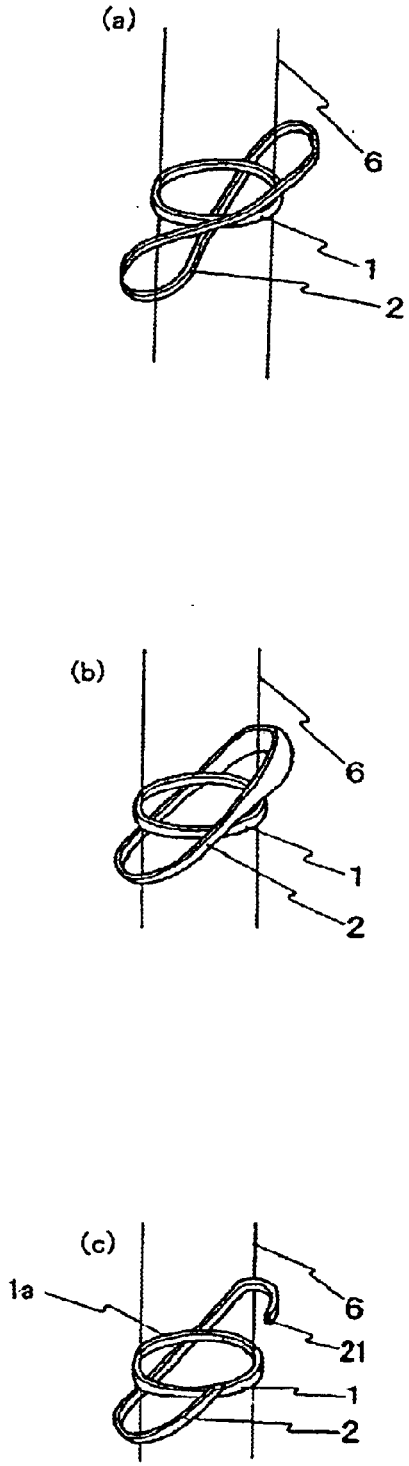
FIGS. 6 are views showing variations where the shape of a tilted ring 2 is changed, and include a view for a variation with the ring main body 1 in a twisted ellipse shape (FIG. 6(*a*)), a view for a variation with the tilted ring 2 having the varying thickness (h) (FIG. 6(*b*)), and a view for a variation with the tilted ring 2 with a disconnection 21 (FIG. 6(*c*))

FIG. 6(*a*) shows a ring main body 1 whose shape is a twisted ellipse. FIG. 6(*b*) shows a ring main body 1 where the thickness (h) of the tilted ring 2 varies. In the example shown in FIG. 6(*b*), the thickness of a part of the tilted ring 2 above the ring main body 1 is large, and the thickness of the tilted ring 2 below the ring main body 1 is small. With the variation shown in FIG. 6(*b*), when the ring is worn on the finger 6 upside down, the esthetic appearance changes while presenting a good taste. FIG. 6(*c*) shows an example where a disconnection 21 is provided on the tilted ring 2.

In the variations described while referring to FIG. 5 and FIG. 6, the ring does not interfere with the other ring 5 even if the ring is worn upside down on the finger 6.

Figure 7:
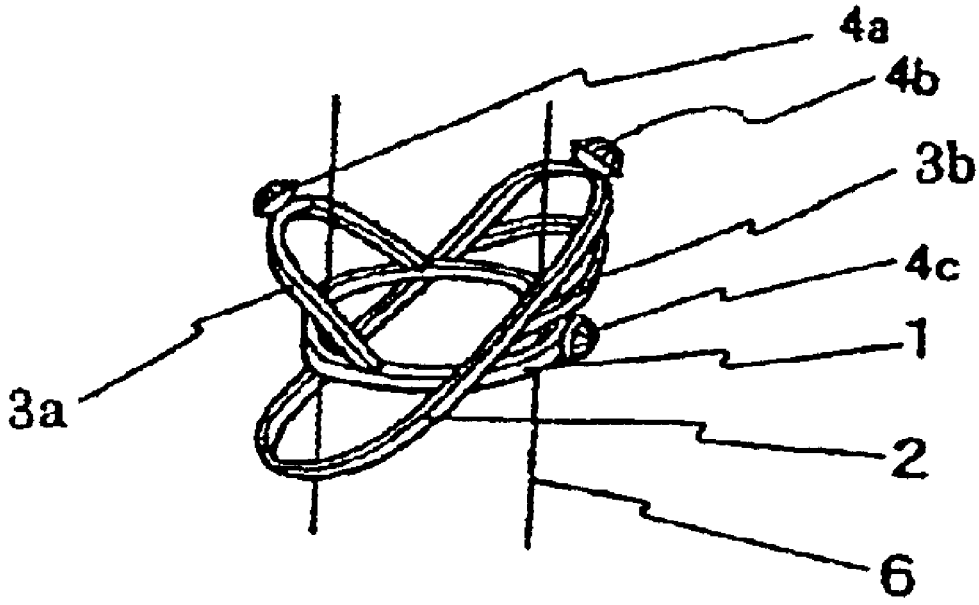
FIG. 7 is a perspective view of a variation where the positions where the arms 3 and decoration members 4 are attached are changed.

The positions where the arms 3 and the decoration members 4 are attached may be changed. FIG. 7 is a perspective view of a variation where the positions where the arms 3 and the decoration members 4 are attached are changed. An arm 3*a* is attached to an end surface of the ring main body 1. An arm 3*b* is attached to an end surface of the tilted ring 2. Both the arm 3*a* and the arm 3*b* are above the ring main body 1. This is because the tilted ring 2 interferes with the other ring 5 if they are above and below the ring main body 1. Additionally, a decoration member 4*a* is attached on the outer periphery of the arm 3*a*, a decoration member 4*b* is attached on the outer periphery of the tilted ring 2, and a decoration member 4*c* is attached on the outer periphery of the ring main body 1.

Second Embodiment

A ring according to a second embodiment is the ring according to the first embodiment with additional spacers 7.

Figure 8:
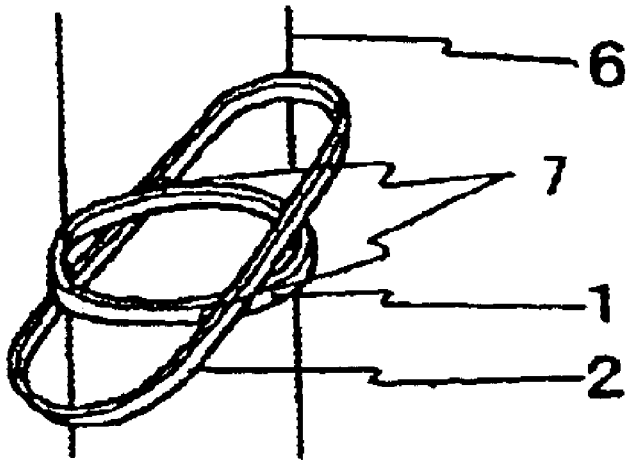
FIG. 8 is a perspective view of a ring according to a second embodiment of the present invention.

FIG. 8 is a perspective view of the ring according to the second embodiment of the present invention. The ring comprises a ring main body 1, a tilted ring 2, an arm 3, a decoration member 4, and the spacers 7. The ring is worn on the finger 6. The arm 3 and the decoration member 4 may not be provided, and they are not shown in FIG. 8. The parts similar to those in the first embodiment are assigned with the same number, and description for them is not provided.

The arm 3 and the decoration member 4 are the similar to those in the first embodiment, and description for them is not provided.

Figure 9:
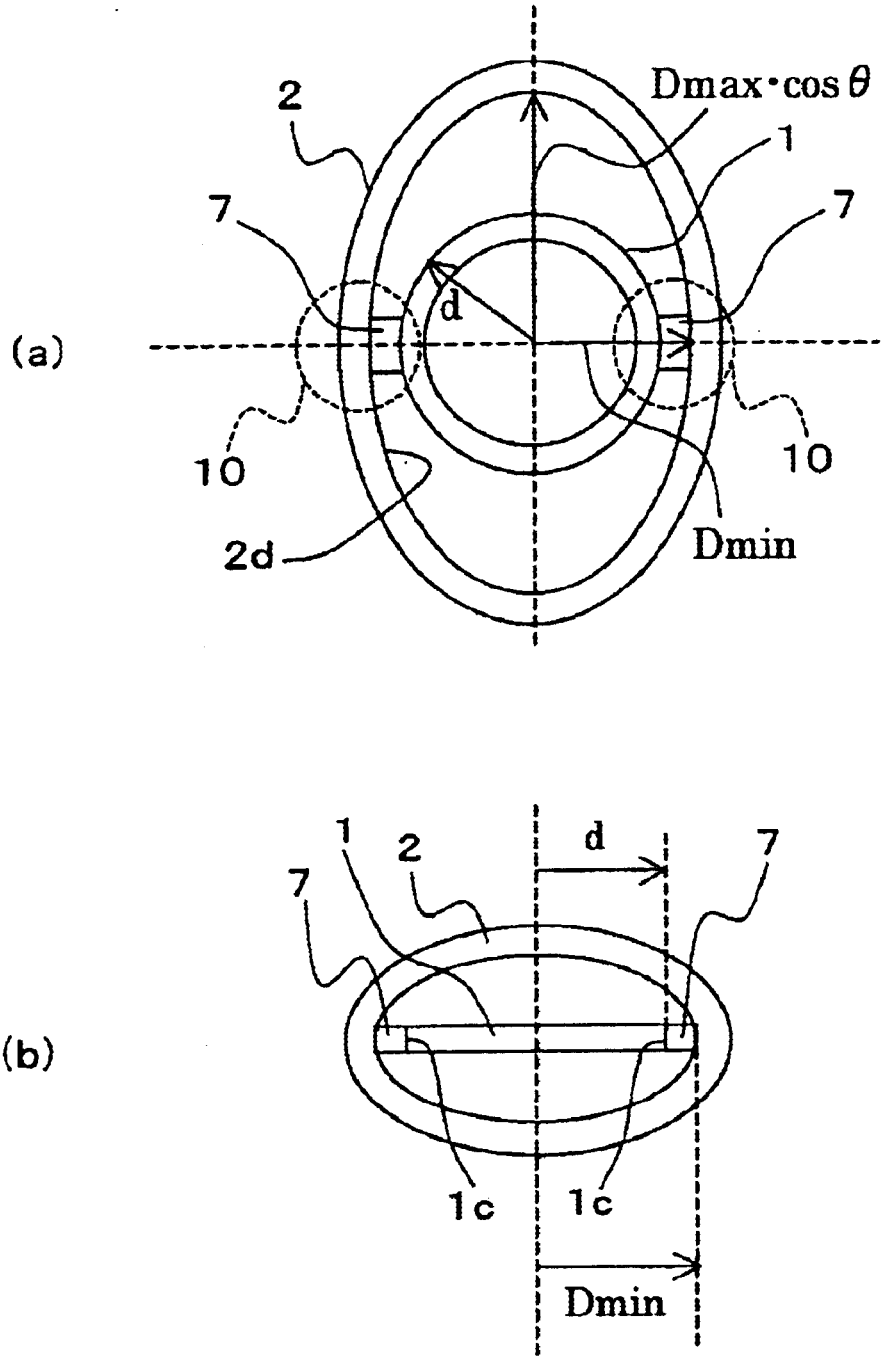
FIGS. 9 include a plan view (FIG. 9(*a*)) and a side view (FIG. 9(*b*)) of the ring according to the second embodiment of the present invention.

Though the ring main body 1 and the tilted ring 2 are almost similar to those in the first embodiment, description is provided for them in addition to the spacers 7 while referring to FIG. 9.

FIG. 9 includes a plan view (FIG. 9(*a*)) and a side view (FIG. 9(*b*)) of the ring according to the second embodiment of the present invention. The arm 3 and the decoration member 4 are not shown. The tilted ring 2 and the ring main body 1 are connected with each other through the spacers 7. The existence of the spacers 7 makes the radius Dmin of the minor axis of the inner periphery of the tilted ring 2 larger than the outside radius (d) of the ring main body 1.

The actions for wearing the ring according to the second embodiment are similar to those of the first embodiment. The tilted ring 2 does not interfere with the other ring 5 even if the outside radius of the other ring 5 is equal to or more than (d) as long as the outside radius is equal to or less than Dmin.

With the second embodiment, the tilted ring 2 does not interfere with the other ring 5 even if the other ring 5 is larger than the ring main body 1.

What is claimed is:

1. A ring comprising:

a ring main body; and a tilted ring tiltingly attached to said ring main body, said ring main body having a single outside radius and said tilted ring having a minor axis with a first, minimum inside radius and having a major axis with a second, maximum inside radius that is larger than the first inside radius wherein the minimum inside radius of said tilted ring is equal to or larger than the outside radius of said ring main body, and the maximum inside radius of the tilted ring projected on a plane where the ring main body exists, at every angle relative to said main ring body, is equal to or larger than the outside radius of the ring main body.

2. The ring according to claim 1, wherein said tilted ring is placed above or below said ring main body.

3. The ring according to claim 1, wherein said tilted ring is an ellipse.

4. The ring according to claim 1, wherein parts where said tilted ring has said minimum inside radius are in contact with the outer peripheral surface of said ring main body.

5. The ring according to claim 1 further comprising spacers placed between parts where said tilted ring has said minimum inside radius and the outer periphery of said ring main body.

6. The ring according to claim 1, wherein a disconnection is provided on said ring main body or said tilted ring.

7. The ring according to claim 1 further comprising an arm attached to an end of said ring main body or said tilted ring, and is placed above or below the ring main body.

8. The ring according to claim 7 further comprising a decoration member attached to said arm.

9. The ring according to claim 1 further comprising a decoration member attached to said ring main body or said tilted ring.

10. The ring according to claim 1, wherein said tilted ring is fixed to said ring main body.

* * * * *